US008064289B2

(12) United States Patent
Poletto et al.

(10) Patent No.: US 8,064,289 B2
(45) Date of Patent: Nov. 22, 2011

(54) MEASURING DEVICE FOR A DRILLING APPARATUS

(75) Inventors: Flavio Poletto, Gorizia (IT); Andrea Schleifer, Staranzano (IT); Giuliano Dordolo, Trieste (IT)

(73) Assignee: Istituto Nazionale di Oceanografia e di Geofisica Sperimentale, Sgonico (IT)

( * ) Notice: Subject to any disclaimer, the term of this patent is extended or adjusted under 35 U.S.C. 154(b) by 1233 days.

(21) Appl. No.: 11/667,217

(22) PCT Filed: Nov. 7, 2005

(86) PCT No.: PCT/EP2005/055775

§ 371 (c)(1),
(2), (4) Date: May 7, 2007

(87) PCT Pub. No.: WO2006/048455

PCT Pub. Date: May 11, 2006

(65) Prior Publication Data

US 2007/0279249 A1 Dec. 6, 2007

(30) Foreign Application Priority Data

Nov. 8, 2004 (IT) ..... UD2004A0207

(51) Int. Cl.
*E21B 47/01* (2006.01)

(52) U.S. Cl. ..... 367/82; 181/108; 702/14

(58) Field of Classification Search ..... 367/82, 367/84; 181/108; 702/14
See application file for complete search history.

(56) References Cited

U.S. PATENT DOCUMENTS

| | | | | |
|---|---|---|---|---|
| 3,993,974 | A | 11/1976 | Silverman et al. | |
| 5,242,025 | A * | 9/1993 | Neill et al. | 175/26 |
| 5,565,860 | A | 10/1996 | Sakata et al. | |
| 6,094,401 | A * | 7/2000 | Masak et al. | 367/84 |
| 6,237,404 | B1 * | 5/2001 | Crary et al. | 175/40 |
| 2006/0131099 | A1 * | 6/2006 | Meynier et al. | 181/108 |
| 2007/0143027 | A1 * | 6/2007 | Nutt et al. | 702/14 |

FOREIGN PATENT DOCUMENTS

WO 03/036042 5/2003

OTHER PUBLICATIONS

International Search Report from corresponding International Application No. PCT/EP2005/055775, mailed Feb. 1, 2006.

* cited by examiner

*Primary Examiner* — Frederic L Lagman
(74) *Attorney, Agent, or Firm* — Hamre, Schumann, Mueller & Larson, P.C.

(57) ABSTRACT

A measuring device for a drilling apparatus which comprises a series of drilling rods, rotary and axially mobile. The measuring device comprises sensors, disposed on the series of rods, and feed devices of the electromagnetic induction type, able to feed the sensors electrically. Each of the devices is connected to a feed source and comprises a rotary element and a stator. A guide unit is mounted on the apparatus, and a slider, on which the stator is supported, is able to slide on the guide unit with an axial motion corresponding to that of the series of rods.

5 Claims, 3 Drawing Sheets

MEASURING DEVICE FOR A DRILLING APPARATUS

FIELD OF THE APPLICATION

The present invention concerns a measuring device used in a drilling apparatus in order to effect seismic measurements during drilling in the ground.

BACKGROUND OF THE INVENTION

Measuring devices are known, which are used in a drilling apparatus to effect seismic measurements exploiting the vibrations produced during drilling in the ground, particularly to determine and acquire reference signals from the source of vibrations, denominated pilot signals, typically used to obtain reliable seismic measurements in this type of device.

A common drilling apparatus generally comprises a tower, a series of rods, coaxial to each other, a motor, which makes the rods rotate, and a drilling element, generally called a bit, mounted on the lower end of said series of rods.

To obtain the desired seismic measurements, during drilling, in one of the typical methods the bit is used as a source of signals. The signals are measured by one or more sensors disposed on the surface of the ground, or in other wells (according to the "cross-hole" technique) adjacent to the excavation, or at a certain distance therefrom, and continuously recorded, or at regular intervals of depth, thus obtaining Vertical Seismic Profiles (VSP) which supply information on the surrounding ground.

In order to be used, a signal supplied by the bit must be identified from among the various noises that are produced during the drilling. To this purpose, the pilot signals are advantageously used. The more reliable the pilot signals are (that is, the greater the signal/noise ratio), the better the geophysical results obtained.

Known measuring devices typically, but not only, effect the measurements of the pilot signals on the series of rods. The measurements are typically, but not only, effected with one or more sensors disposed, in a first solution, on non-rotating parts of the upper part of the series of rods, hereafter denominated head. In another solution, the sensors are inserted in the rods themselves, and therefore also rotate during drilling. In this case, the sensors must be fed with a plurality of electric batteries, or turbine generators mounted on the rods, which entails great complexity in construction and, above all, maintenance problems. Moreover, the data detected by the rotary sensors is disadvantageously recorded locally first and then transmitted when the drilling apparatus is stationary, or is transmitted via radio with a consequent increase in the consumption of electric energy and reduction in autonomy of the batteries.

Another solution for feeding the sensors provides to use sliding contacts with consequent problems of contact, wear, friction and the need to have anti-spark properties, in order to prevent phenomena of deflagration in the case of drilling in the presence of combustible fluids.

To overcome these disadvantages, measuring devices which comprise an electromagnetic induction system (hereafter EMI devices) have also been proposed, which allows both to supply energy to the sensors inserted in the rods and also to transmit the data from the rotary part to a fixed part, mounted on the non-rotary part of the head of the series of rods, or in other parts of the plant. This feed and transmission system comprises a rotary part, functioning as a rotor, and a rotationally fixed part, functioning as a stator, which is disposed in a position of cooperation with a part of the rotor itself, in order to achieve the effect of electromagnetic induction without mechanical contact, thus eliminating the problems connected to wear and friction typical of sliding contacts.

Measuring devices that comprise this electromagnetic induction feed and transmission system cannot, however, be used in drilling apparatuses where the head on which the stator is fixed and the rods move relatively in an axial manner. In this case, the inductive coupling which is achieved by keeping the rotary part and the stator part close together cannot be achieved due to the axial motion of the series of rods. For example, this occurs in drilling apparatuses provided with a so-called top-drive equipment, that is, having the motor mounted directly on the head of the series of rods. In fact, with this configuration, the series of rods can not only rotate but can also slide axially with respect to the motor in order to attenuate, by means of a damping system, the axial stresses caused by the drilling.

One purpose of the present invention is to achieve a measuring device for drilling apparatuses which uses an electromagnetic induction feed and transmission system so that, during drilling, the sensors are fed without suffering from the axial motion of the rods with respect to the mechanical system mounted on the head of the series of rods, or on other parts of the plant, and also so that the measurements effected by the sensors located on the rods themselves are transmitted during the drilling operations of the drilling apparatus.

The Applicant has devised, tested and embodied the present invention to overcome the shortcomings of the state of the art and to obtain these and other purposes and advantages.

SUMMARY OF THE INVENTION

The present invention is set forth and characterized in the main claim, while the dependent claims describe other characteristics of the invention or variants to the main inventive idea.

In accordance with the above purpose, a measuring device according to the present invention is used in a drilling apparatus, which comprises at least a tubular drilling element, or rod, able to rotate and move axially during the drilling operation.

The measuring device comprises sensor means, disposed on the tubular element and able to detect signals to obtain seismic measurements during the drilling operation, and at least a feed system of the electromagnetic induction type, able to feed electrically the sensor means and connected to a source of electric feed.

The feed system comprises a rotary element, or rotor, mounted coaxial and solid with the tubular element, and a rotationally fixed part, functioning as a stator, disposed on the head of the tubular element or on other parts of the apparatus, in a position of cooperation with the rotary element. The stator is fed by the electric feed source.

According to a characteristic of the present invention, the measuring device also comprises guide means, mounted on the drilling apparatus, and mobile supporting means, on which the part functioning as a stator is supported, which is able to slide on the guide means with an axial motion substantially corresponding to that of the tubular element. In this way the stator always remains in a defined position of cooperation with the rotary element, solid with the tubular element. This allows to generate, during the drilling operation, the effect of electromagnetic induction, and hence consents both to feed the sensor means whatever axial position is assumed by the tubular element, and also to measure and transmit the signals in real time.

According to a preferential embodiment, the mobile supporting means comprises connection means that connects it to a guide element, mounted coaxial and solid with the tubular element, so that the axial motion of the tubular element is transmitted to the mobile supporting means.

According to a variant, the connection means comprises rolling means able to contact at least the upper and lower surfaces of the guide element.

During the drilling operation, because it is solid and coaxial with the tubular element, the guide element rotates, making the rolling means disposed on opposite sides of the guide element rotate, and moves with an axial motion, putting pressure on one or the other of the rolling means according to the direction of the relative axial motion; with this configuration, the axial motion of the tubular element is transmitted to the rolling means, and from it to the mobile supporting means and hence to the stator part mounted thereon.

According to another variant, the guide means comprises a support mounted on the drilling apparatus and at least two cylindrical guides, mounted on the support so as to be parallel to each other, and also parallel to the axis of the tubular element.

According to another variant, the mobile supporting means comprises at least two sliding elements, each of which is able to slide on a corresponding cylindrical guide, a first arm, mounted on the sliding elements and able to support the part functioning as the stator, and a second arm, mounted on the sliding elements, for example parallel to the first arm, and able to support the connection means.

Thanks to the fact that it keeps a substantially fixed and defined position, within the limits of mechanical tolerance, between the rotor part and the stator part, the measuring device according to the present invention allows, whatever axial position is assumed by the tubular element during the drilling operation, both to feed the sensor means and also to transmit the signals without interrupting the functioning of the drilling apparatus, and also to effect seismic measurements during the drilling itself.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
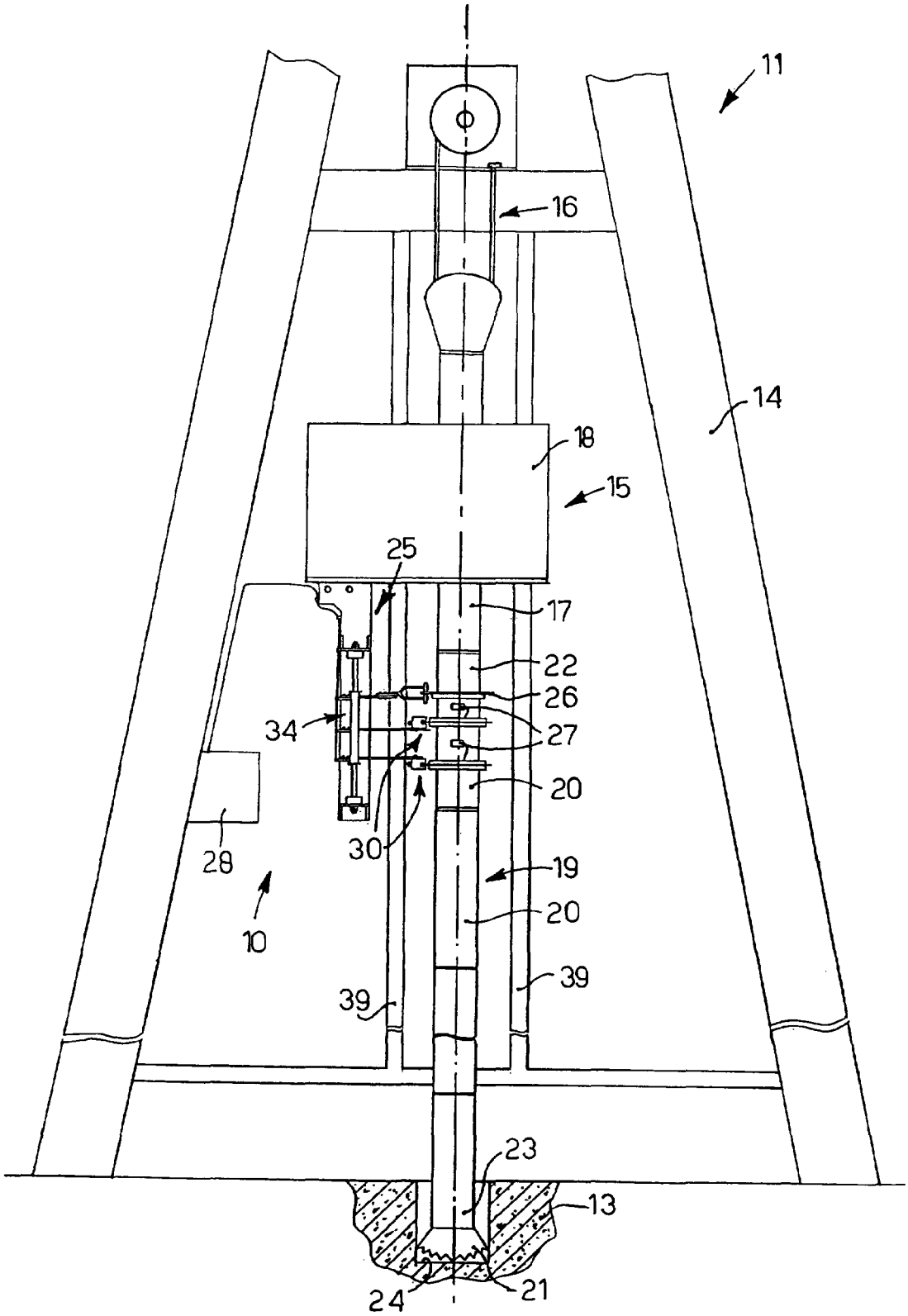
FIG. 1 is a front schematic view of an apparatus comprising the measuring device according to the present invention.
Figure 2:
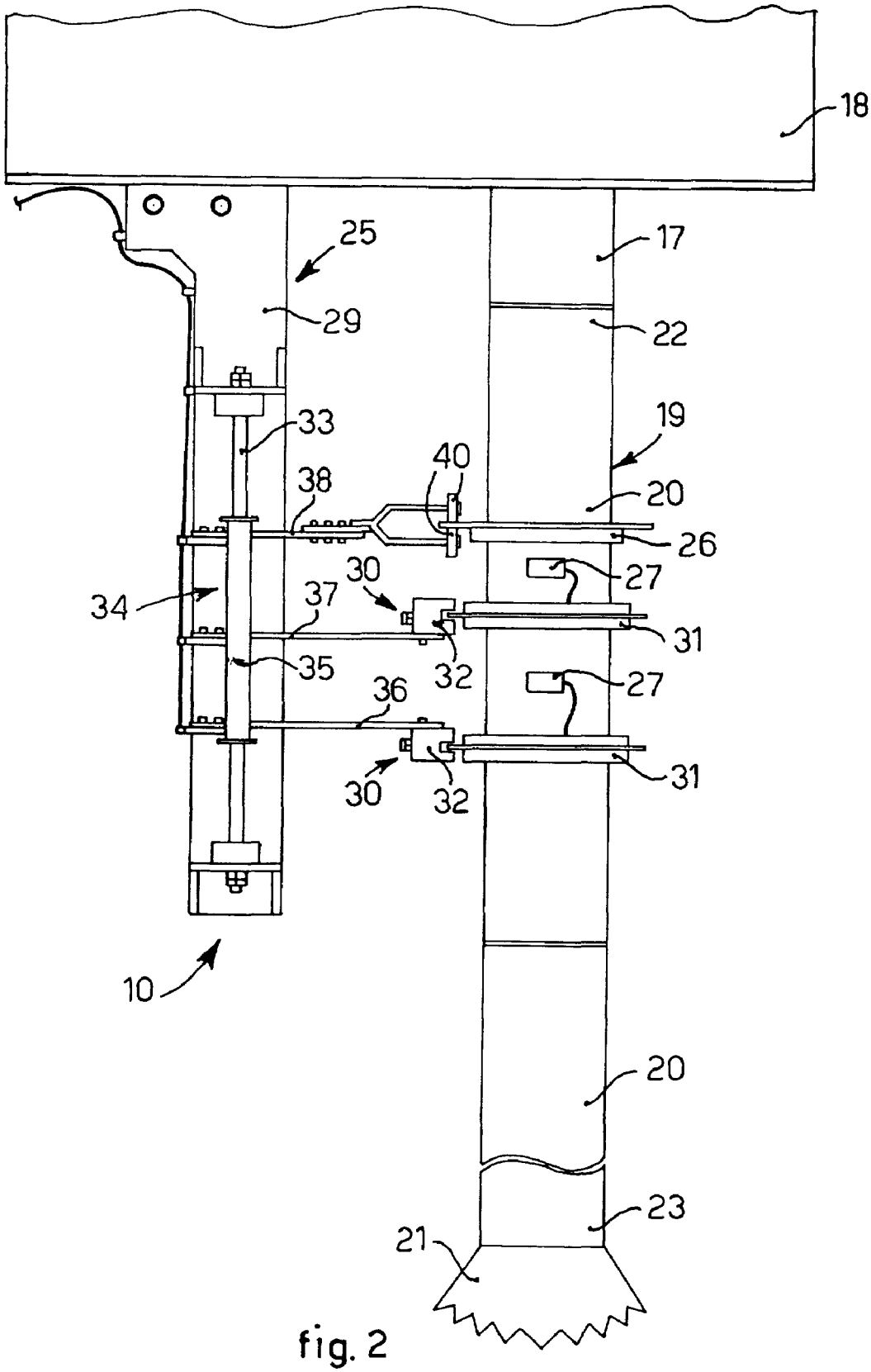
FIG. 2 is an enlargement of a detail in FIG. 1.

With reference to FIGS. 1 and 2, a measuring device according to the present invention denoted generally with all its components, main and accessory, with the reference number 10, is used in a drilling apparatus 11, only partly shown, in order to obtain the necessary reference signals to obtain seismic measurements during the drilling operation in a ground 13.

The apparatus 11 comprises a drilling tower 14 and a mobile drilling unit 15, which can be raised and lowered, for example sliding on guides 39 made on said tower 14.

The mobile drilling unit 15, in this case of the so-called top drive type, in turn comprises a movement unit 16, of a known type, mounted on the drilling tower 14 and able to move the whole mobile drilling unit 15 vertically, a motor 18, connected to the movement unit 16, a series of tubular elements or rods 19 comprising a plurality of rods 20 coaxial with each other, a damping device 17 and, at the end, a drilling element, called bit 21.

The series of rods 19 comprises an upper end 22, with which the top drive is associated, mounted coaxial with the shaft of the motor 18, and a lower end 23, on which the bit 21 is mounted. The motor 18 makes the series of rods 19, and consequently the bit 21, rotate, so as to make a hole 24 in the ground 13. Afterwards, the drilling unit 15 is moved downwards, for example to increase the depth of the hole 24.

The damper device 17, of a known type, is for example interposed between the motor 18 and the upper end 22 of the series of rods 19 and allows the latter to move with an axial motion with respect to the motor 18, so as to absorb the stresses or impacts generated during the drilling operation.

The comparison of the signals, that is, the vibrations generated by the bit 21 and the pilot signals detected by means of the measuring device 10 allows to separate the signals useful for the seismic measurements with respect to the noises that are generated during the drilling operation.

The measuring device 10 comprises a guide unit 25, mounted on the mobile drilling unit 15, in this case below; a slider 34, mounted sliding on the guide unit 25; a guide disk 26, keyed onto the series of rods 19 in correspondence with the guide unit 25; one or more sensors 27, in this case two, mounted on the series of rods 19 in order to detect the pilot signals directly on the rods 20; two electromagnetic induction feed and transmission devices, denominated EMI devices 30; and a detection and feed, and possibly recording, unit 28, which both supplies electric feed to both the EMI devices 30 and also detects the signals produced by the sensors 27.

The sensors 27 in this case are signal transducers which generate an electric signal used without limitations as an analogical and/or digital signal.

Each EMI device 30 comprises a rotary element, or rotor 31, mounted solid and coaxial with the series of rods 19 and a rotationally fixed element, or stator 32, mounted on the guide unit 25, connected to the detection and feed unit 28 and able to contain, with play, a part of the periphery of the rotor 31, so as to prevent problems of interference and friction due to mechanical contact between the stator 32 and rotor 31.

During the drilling operation, the rotation of the series of rods 19 causes the rotation of the rotor 31 inside the stator 32, between which, due to the effect of the electric feed of the stator 32 by the detection and feed, and possibly recording, unit 28, the phenomenon of electromagnetic induction is generated.

The electric current supplied through the stator 32 is used both to feed the sensors 27, for example connected by cable to the rotor 31, and also to transmit easily to the detection and feed unit 28 the analogical and/or digital signals measured by the sensors 27 themselves.

Figure 3:
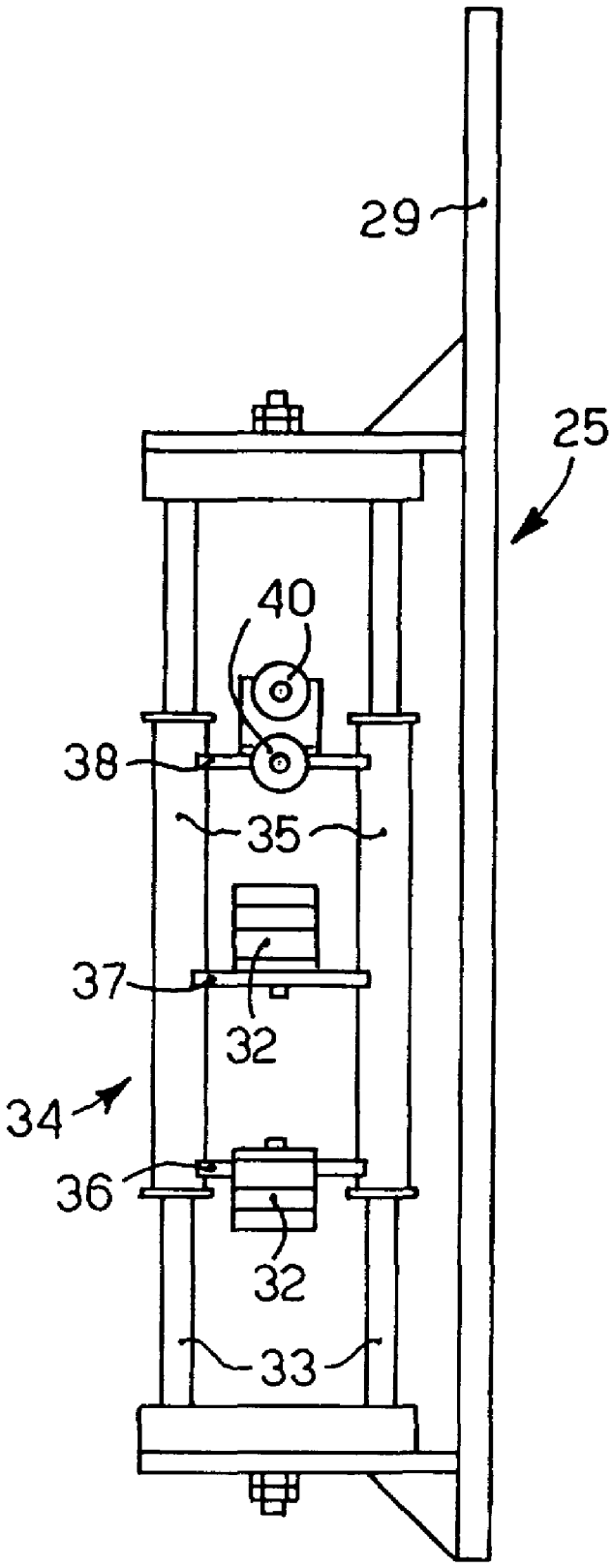
FIG. 3 is a lateral view of an enlarged detail of the measuring device in FIG. 1.

The guide unit 25 (FIGS. 2 and 3) comprises a support 29, advantageously metal, mounted on the mobile drilling unit 15, and two cylindrical guides 33, mounted on the support 29, both parallel to each other and also parallel to the series of rods 19.

The slider comprises two sleeves 35, mounted coaxial and sliding on the corresponding cylindrical guides 33, and three metal arms 36, 37 and 38, attached to both the sleeves 35 and in this case disposed perpendicular to the latter and parallel to each other.

Each of the first two arms 36 and 37 supports the stator 32 of a corresponding EMI device 30, while the third arm 38 is disposed in correspondence with the guide disk 26 and comprises two connection wheels, of small diameter. The latter have their axes of rotation parallel and suitably distanced from each other, so that each wheel 40 contacts a corresponding lower and upper surface of the guide disk 26 and, in use, is made to rotate with an anti-friction function.

Thanks to this configuration, the third arm 38 is connected to the guide disk 26, making the slider 34 move along the cylindrical guides 33 with a vertical axial motion coordinated to and of the same entity as that of the series of rods 19; this consequently allows the stators 32 both to remain always aligned with the corresponding rotors 31, and also to accommodate with play the peripheral part of the corresponding rotor 31, whatever the position assumed by the series of rods 19 with respect to the motor 18, within the limits of constructional tolerance. It is therefore possible, during the entire drilling operation, both to guarantee a constant electric feed to the sensors 27, and also to transmit the signals detected by the sensors 27 to the detection and feed unit 28, also when disposed remote with respect to the measuring position.

It is clear that modifications and/or additions of parts may be made to the measuring device 10 as described heretofore, without departing from the field and scope of the present invention.

For example, the wheels 40 mounted on the third arm 38 may be replaced by two bearings, not shown here, each disposed in contact with a corresponding surface of the guide disk 26.

It is also clear that, although the present invention has been described with reference to some specific examples, a person of skill in the art shall certainly be able to achieve many other equivalent forms of measuring device for a drilling apparatus, having the characteristics as set forth in the claims and hence all coming within the field of protection defined thereby.

The invention claimed is:

1. A measuring device for a drilling apparatus, said apparatus comprising at least a tubular drilling element able to rotate and to move axially, said measuring device comprising sensor means, disposed on said tubular element and able to detect signals to effect seismic measurements during the drilling operation, and at least a feed system of the electromagnetic induction type, able to feed said sensor means electrically, connected to a feed source and comprising a rotary element, mounted coaxial and solid with said tubular element, and a rotationally fixed part, or stator, disposed in a position of cooperation with said rotary element, the device further comprising guide means, mounted on said apparatus, and mobile supporting means, on which said stator is supported, able to slide on said guide means with an axial motion substantially corresponding to that of said tubular element, in such a manner that said stator can be always in a defined position of cooperation with said rotary element in any position whatsoever assumed by said tubular element during the drilling operation.

2. A measuring device as in claim 1, wherein said mobile supporting means comprises connection means able to connect said mobile supporting means to a guide element, mounted coaxial and solid with said tubular element.

3. A measuring device as in claim 2, wherein said connection means comprises rolling means able to contact at least the upper and lower surfaces of said guide element, so that the alternate motion of said tubular element is transmitted to said mobile supporting means.

4. A measuring device as in claim 1, wherein said guide means comprises a support mounted on said apparatus and at least two cylindrical guides, mounted on said support.

5. A measuring device as in claim 4, wherein said mobile supporting means comprises at least two sliding elements, each able to slide on the corresponding one of said cylindrical guides, at least a first arm, mounted on said sliding elements and able to support said stator, and a second arm mounted on said sliding elements and able to support said connection means.

* * * * *